US007306056B2

(12) United States Patent
Ballantyne et al.

(10) Patent No.: US 7,306,056 B2
(45) Date of Patent: Dec. 11, 2007

(54) DIRECTIONAL CASED HOLE SIDE TRACK METHOD APPLYING ROTARY CLOSED LOOP SYSTEM AND CASING MILL

(75) Inventors: Ray Ballantyne, Houston, TX (US); Joachim Oppelt, Hannover (DE)

(73) Assignee: Baker Hughes Incorporated, Houston, TX (US)

( * ) Notice: Subject to any disclaimer, the term of this patent is extended or adjusted under 35 U.S.C. 154(b) by 310 days.

(21) Appl. No.: 10/977,671

(22) Filed: Oct. 29, 2004

(65) Prior Publication Data

US 2005/0150692 A1 Jul. 14, 2005

Related U.S. Application Data

(60) Provisional application No. 60/517,642, filed on Nov. 5, 2003.

(51) Int. Cl.
*E21B 7/04* (2006.01)

(52) U.S. Cl. ..... 175/61; 175/76; 175/266

(58) Field of Classification Search ..... 175/61, 175/76, 313, 50
See application file for complete search history.

(56) References Cited

U.S. PATENT DOCUMENTS

| | | | | |
|---|---|---|---|---|
| 3,289,760 | A | 12/1966 | Kammerer | |
| 5,443,129 | A | 8/1995 | Bailey et al. | 175/45 |
| 6,273,290 | B1 | 8/2001 | Cheng | 166/285 |
| 6,310,416 | B1 | 10/2001 | Chang | 310/105 |
| 6,622,792 | B1 | 9/2003 | Schick | 166/313 |
| 6,695,056 | B2 | 2/2004 | Haugen et al. | 166/297 |
| 6,715,567 | B2 * | 4/2004 | Delgado et al. | 175/61 |
| 6,923,273 | B2 * | 8/2005 | Terry et al. | 175/45 |
| 2001/0040054 | A1 | 11/2001 | Haugen et al. | 175/61 |
| 2002/0170713 | A1 | 11/2002 | Haugen et al. | 166/298 |
| 2004/0159466 | A1 | 8/2004 | Haugen et al. | 175/61 |

FOREIGN PATENT DOCUMENTS

| | | |
|---|---|---|
| GB | 2308139 | 6/1997 |
| GB | 2312702 | 11/1997 |
| GB | 2341878 | 3/2000 |
| GB | 2 357 101 | 6/2001 |
| WO | WO98/13572 | 4/1998 |

* cited by examiner

*Primary Examiner*—David Bagnell
*Assistant Examiner*—Brad Harcourt
(74) *Attorney, Agent, or Firm*—Madan, Mossman & Sriram, P.C.

(57) ABSTRACT

A bottomhole assembly (BHA) for single trip sidetracking operations has a mill for forming an open hole section in a cased wellbore and a steering unit for controlling drill bit orientation. During use, the drilling system is assembled at the surface and tripped into the wellbore. The mill is positioned adjacent a kick-off point and operated to form an open hole section. Thereafter, the drill bit is positioned adjacent the open hole section. An exemplary steering unit includes one or more force application members that, when energized, displace the drill bit such that the bit is pointed in a specified direction into the open hole section. The steering unit also includes one or more force application members that facilitate directional drilling through the open hole section. Other suitable steering units can employ devices that alter the BHA centerline geometry.

40 Claims, 3 Drawing Sheets

DIRECTIONAL CASED HOLE SIDE TRACK METHOD APPLYING ROTARY CLOSED LOOP SYSTEM AND CASING MILL

CROSS-REFERENCE TO RELATED APPLICATIONS

This application takes priority from U.S. Provisional Application Ser. No. 60/517,642 filed Nov. 5, 2003, titled "Directional Cased Hole Side Track Method Applying Rotary Closed Loop System and Casing Mill."

BACKGROUND OF THE INVENTION

1. Field of the Invention

This invention relates, in certain aspects, to systems and methods for forming an open hole section in a cased well and drilling a directional wellbore therefrom during a single trip into a wellbore.

2. Description of Related Art

For efficient and cost-effective recovery of hydrocarbons from a subterranean formation, it may at times be advantageous to drill a directional or branch wellbore from a location ("kick-off" point) along a cased main wellbore. Conventionally, the drilling of this directional wellbore, sometimes referred to as a sidetracking operation, requires the use of a number of different tools and multiple trips into the wellbore. As is known, a conventional bit (e.g., tri-cone bit) is not suited for cutting through the metal wall of a casing. Thus, a typical sidetracking operation begins by first assembling at the surface a work string provided with a suitable mill for cutting the metal wall of a casing to thereby form an open hole section in a cased wellbore. The work string provided with the mill is tripped into the wellbore, positioned at the anticipated kick-off point for the branch wellbore, and operated to remove casing material to form the open hole section. After the open hole section is formed, the work string is pulled out of the well bore and disassembled. To direct a BHA into the open hole section, many conventional methods use a device such as a deflector (e.g., a whipstock) below the open hole section. This deflector is positioned in the main wellbore using another work string that is tripped into and out of the wellbore. Thereafter, a drill string provided with a bottomhole assembly is tripped into the wellbore and guided into the open hole section by the deflector. Still another operation such as a drill-out or fishing operation may be needed to remove the deflector.

As is known, rig time is a factor in the cost of constructing a hydrocarbon producing well. The repeated assembly and disassembly of work string and tools used in conventional sidetracking operations increases rig time and thereby increases the cost to the well operator. Likewise, tripping work string and drill string thousands of feet into a well also consumes rig time and cost. Moreover, each trip-in or trip-out carries with it a risk of equipment failure (e.g., a tool becoming stuck in the hole).

The present invention addresses the need for a more efficient and effective single-trip milling method and systems for sidetracking and other similar operations.

SUMMARY OF THE INVENTION

In one aspect, the present invention provides a bottom hole assembly (BHA) adapted to drill a directional wellbore from a cased section of a main wellbore in a single trip. The BHA includes a mill for forming an open hole section in the cased section and a steering unit for actively guiding a drill bit into the open hole section. The steering unit orients the drill bit in accordance with a selected coordinate (e.g., azimuth and inclination) for entry into the open hole section and selected well profile or path for directional drilling. The drill bit is rotated by a surface and/or local source (e.g., downhole motor, rotary table, or both).

In one embodiment, the steering unit includes a set of force application members configured to provide a selected force against a wellbore wall. The force application members are configured to provide sufficient lateral displacement of the drill bit such that the drill bit enters the milled open hole section. In one embodiment, one or more force application members is modified to include an elongated arm that provides the enhanced lateral positioning for the drill bit. Optionally, the steering unit can include a second set of force application members disposed a suitable distance uphole of a first set of force application members. The casing mill is adapted to form an opening in the cased wellbore section through which a directional wellbore can be drilled. In one embodiment, the mill has one or more collapsible cutting members that selectively extend out radially. Rotation of the cutting members provides the cutting action that removes the metal or other material making up the casing.

Tools and equipment such as flex subs and stabilizers can be used to enhance the operation of the BHA. For instance, a flex sub provided adjacent and uphole of the steering unit can be used to allow the steering unit to deflect the drill bit orientation relative to the wellbore. Also, one or more active or fixed-blade stabilizers provided adjacent the steering unit and uphole of the flex sub can be used to center the mill during operation. Additionally, on-board sensors and processors can be used to improve control and operation of the BHA. For example, the BHA preferably includes navigation devices to provide information about parameters that may be utilized downhole or at the surface to control the azimuthal orientation of the BHA drilling direction and sensors for measuring drilling motor parameters such as the fluid flow rate, pressure drop, torque, and the rotational speed (RPM) of the motor. The BHA may also include any number of additional sensors known as the measurement-while-drilling devices or logging-while-drilling devices for determining various borehole and formation parameters or formation evaluation parameters, such as resistivity, porosity of the formations, density of the formation, and bed boundary information. In one embodiment, the BHA includes an acoustic sensor for determining the adequacy of the cement bond at the region of the cased section selected for milling. A suitable surface and/or downhole controller receives the signals from the various downhole sensors, determines the values of the desired parameters based on the algorithms and models provided to the controller and in response thereto controls the various downhole devices. The controller may be programmed to cause the BHA to adjust the steering devices to direct the BHA into the open hole section of the wellbore and/or drill the wellbore along the desired profile.

During an exemplary operation, the drilling system is assembled at the surface and conveyed into the well. An on-board sensor, such as an acoustic sensor, is activated to survey the cement bond along a section of the casing selected as the exit point for the sidetrack. After a location with a suitable cement bond is found, the cutting mill is positioned vertically adjacent the anticipated kick-off point. The cutting members of the mill are expanded and rotated to remove casing material such that an exposed surface of earth and/or cement is formed. Thereafter, the cutting members are locked in their retracted positions and the BHA is moved uphole until the drill bit is positioned adjacent the open hole section. To initiate the drilling of the sidetrack, a force application member is energized to engage the interior surface of the wellbore or casing. The force application member provides a controlled side force against the interior surface that laterally displaces the drill bit. After the drill bit engages the exposed surface at the milled section, the drill bit is rotated to form the side-track. The force application member remains energized so that a bit force is available as the drill bit cuts into the open hole section. Directional drilling through the open hole section can then proceed with a controller monitoring the drilling direction from suitable sensors in the BHA and in response thereto adjusts or manipulates the force application members in a manner that causes the drill bit to drill along a selected drilling direction.

Examples of the more important features of the invention thus have been summarized rather broadly in order that the detailed description thereof that follows may be better understood, and in order that the contributions to the art may be appreciated. There are, of course, additional features of the invention that will be described hereinafter and which will form the subject of the claims appended hereto.

BRIEF DESCRIPTION OF THE DRAWINGS

For detailed understanding of the present invention, references should be made to the following detailed description of the preferred embodiment, taken in conjunction with the accompanying drawings, in which like elements have been given like numerals and wherein.

DETAILED DESCRIPTION OF THE INVENTION

In one aspect, the present invention provides a bottom hole assembly (BHA) that is adapted to form an opening in a cased section of a main wellbore and drill a sidetrack from the opening. Advantageously, the BHA includes the equipment and tooling to accomplish both tasks during a single trip into the wellbore. An exemplary BHA uses an expandable milling unit to form an opening by removing casing material, cement and other material from a selected cased wellbore section. One or more force application members that extend from the BHA facilitate entry into the opening by urging the BHA into the milled opening. Embodiments adapted to execute sidetracks from a cased wellbore during a single trip are discussed in further detail below.

Figure 1:
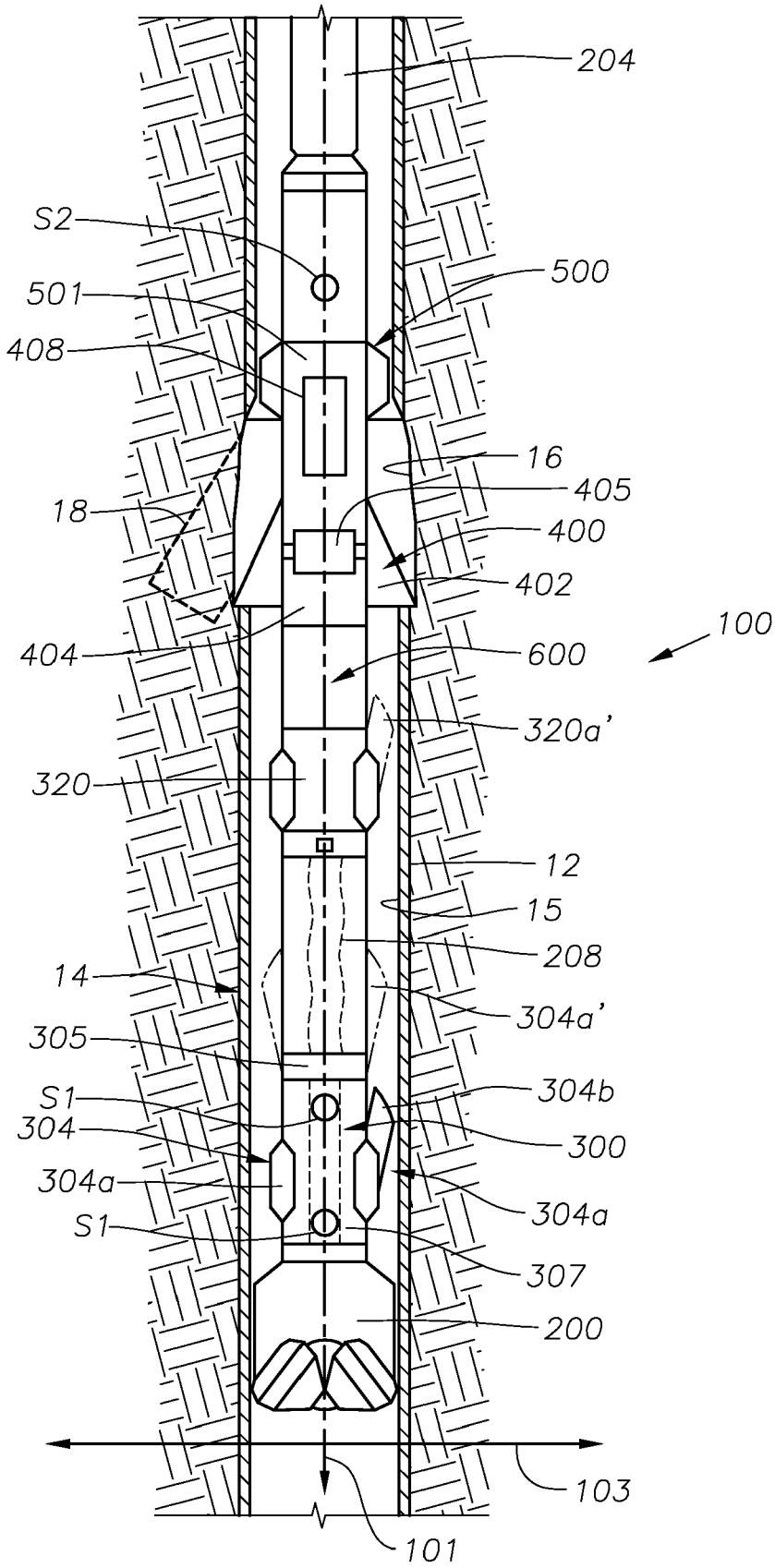
FIG. 1 illustrates a schematic of a BHA made according to one embodiment of the present invention for single trip drilling of directional wellbores from a cased wellbore.

Referring now to FIG. 1, there is schematically illustrated a bottom hole assembly (BHA) 100 according to one embodiment of the present invention positioned in a wellbore 14 having a casing 12 therein. The BHA 100 is configured to produce a side track bore 18 from a milled open hole portion 16. The BHA 100 includes a drill bit 200 guided by a steering unit 300 and a casing mill 400 for milling an opening or window 16 in the cased section 12.

Figure 2:
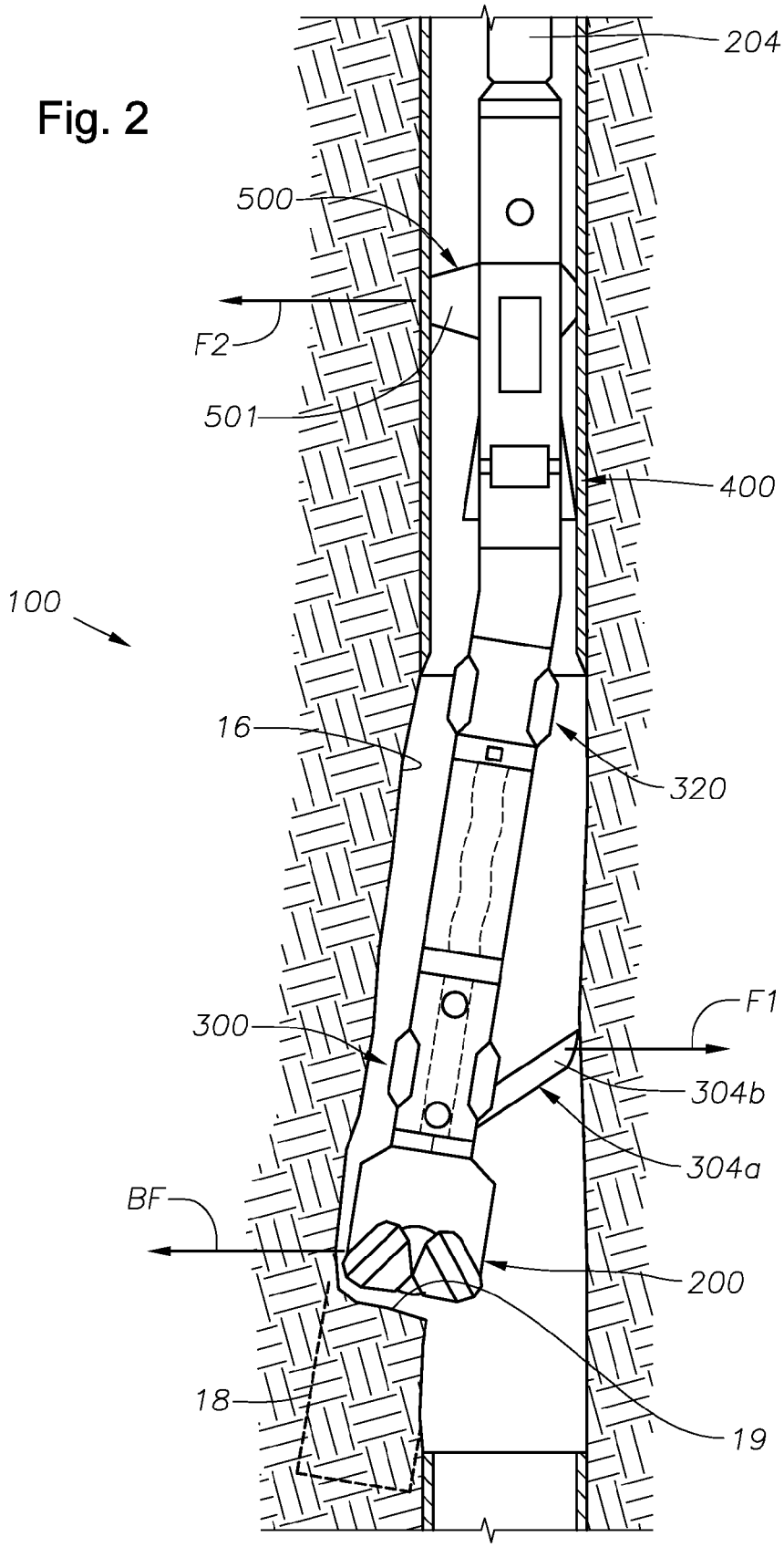
FIG. 2 illustrates a directional wellbore being formed from a cased wellbore using a BHA shown in FIG. 1.

In one embodiment, the steering unit 300 dynamically adjusts the position of the BHA 100 and the drill bit 200 relative to a reference axis (e.g., a wellbore axis 101). The steering unit 300 can, for example, set the drill bit 200 at a selected or predetermined coordinate (e.g., azimuth and inclination) to facilitate insertion into the milled window 16 and/or to guide the bit 200 along a selected drilling direction. In one configuration, the steering unit 300 includes a set of force application members 304 in a non-rotating sleeve 307 that is disposed above the drill bit 200 (e.g., in a bearing assembly of a drilling motor 208). The force application members 304 can be adjusted to any position between a collapsed position, as shown in FIG. 1, and a fully extended position as shown in FIG. 2. The force application members 304 are configured to provide a selected force against a casing or wellbore wall 15. In certain arrangements, the force application members 304 are ribs or pads that can be actuated together (concentrically) or independently (eccentrically) in order to steer the drill bit 200 in a given direction.

The steering unit 300 includes three or more force application members 304 for adequate control of the steering direction and is susceptible to a number of embodiments. A few illustrative embodiments are described herein. In one embodiment, all of the force application members 304 are structurally/operationally similar (e.g., have similar mechanical linkages, geometry, and actuation mechanisms). Thus, any one of the force application members 304*a* can be used to laterally displace the drill bit 200 such that the drill bit 200 enters the milled open hole 16. In some applications, the steering unit 300 includes a force application member 304*a* modified to include a positioning pad, rib, or arm 304*b* that has a relatively longer extension and/or wider sweep or range of rotation than that of adjacent force application members 304. The positioning arm 304*b* provides enhanced lateral displacement or bit inclination relative to the wellbore. The modified force application member 304*a* can be used during directional drilling and also to urge the drill bit 200 into the open hole 16.

In other arrangements, the modified force application member 304*a* is a device that is only operated when urging the drill bit 200 into the open hole 16 and is not used during steering of the drill bit 200. For example, the modified force application member 304*a* can be interposed between or axially spaced apart from the force application members 304 used to steer the drill bit 200. The modified force application member 304*a* can also be structurally or operationally separate from the steering unit 300. For example, a modified force application member 304*a*' can be disposed in a sub 305 in the BHA 100. The sub 305 can be a modular assembly that is readily made-up or uncoupled from the BHA 100. The modified force application member 304*a*' and the sub 305 can be used in conjunction with steering units utilizing bit pointing or deflection systems other than force application members 304 that are disposed on a non-rotating sleeve. For instance, the force application members 304*a* can be used with steering units that alter the tool centerline geometry to point the drill bit 200 in a selected direction by using adjustable bent subs, inflatable bladders or adjustable wedges to deflect the drill bit 200. Other steering systems will be known to one skilled in the art.

The force application members 304, 304*a*, 304*a*' may be actuated by any suitable method, such as by a hydraulic system that utilizes sealed fluid in the BHA 100, by an electro-hydraulic system wherein a motor drives the hydraulic system, or by an electromechanical system wherein a motor drives the force application members 304, 304*a*, 304*a*'. In some arrangements, a single power source may be used to energize all the force application members 304, 304*a*, 304*a*' whereas in other arrangements two or more power sources may be used to energize and operate the force application members 304. Also, the modified force application members 304*a*, 304*a*' can be either structurally/operationally similar to the force application member 304 or have different actuating mechanisms and operating parameters. Additionally, one or more sensors (not shown) may be provided to measure a parameter of interest (e.g., displacement, force applied by each force application member 304, pressure, etc.) relating to the force application members 304 and/or associated drive system. Suitable steering units, force application members, sensors and related systems are discussed in U.S. Pat. Nos. 5,168,941; and 6,513,606, the disclosures of which are incorporated herein by reference, and which are commonly assigned to the present assignee.

Optionally, the steering unit 300 can include a second set of force application members 320 disposed a suitable distance uphole of the first set of force application members 304. The spacing of the two sets of force application members 304, 320 will depend upon the particular design of the drilling system. The force applied by and the radial extension of the force application members 320, which can include one or more modified force application members 320*a*, may be different from that of the force application members 304.

It should be appreciated that the above-described features provide enhanced control over the positioning of the BHA 100 relative to the wellbore axis 101. In particular, the lateral position of the BHA 100 relative to the wellbore 14 can be sufficiently adjusted or shifted to enable the BHA 100 to enter the milled opening 16. Exemplary tooling for forming the opening 16 is described below.

The opening 16 in the cased wellbore section 12 is formed by a rotating mill 400 fixed in the BHA 100. In one embodiment, the mill 400 has one or more radially expandable or extensible cutting members 402 and an actuation device 405 for urging the cutting members 402 into contact with the casing 12. An exemplary actuation device 405 can include a controller 408 that is operably coupled to an electric motor, valves of a hydraulic circuit, or other suitable drive source. For example, the controller 405 can open valves (not shown) to inject pressurized drilling fluid into a piston-cylinder arrangement or close an electric circuit to transmit power to an electric motor. The actuation device 405 can be responsive to a surface command signal for initiating the extension of the cutting members 402. The controller 408 can also be programmed with instructions for automatically or semi-automatically initiating the extension of the cutting members 402 in response to a measured parameter (e.g., drilling fluid pressure). The command signal can be transmitted to the actuation device 405 via a suitable bi-directional telemetry system (not shown). In one embodiment, the cutting members 402 can be selectively locked in their retracted position.

The cutting members 402 can be blades having hardened cutting elements such as teeth formed thereon. Milling tools are disclosed in U.S. Pat. No. 5,899,268, which is commonly assigned and which is hereby incorporated by reference for all purposes. Rotation of the cutting members 402 about the wellbore axis 101 provides the cutting action that removes the metal or other material making up the casing 12. Furthermore, while one row of cutting members 402 is depicted in FIG. 1, it should be understood that multiple rows of axially spaced-apart cutting members could also be used in certain embodiments. Moreover, one set of cutting members can be configured to cut through the metal of the casing and another set of cutting members can be configured to cut through cement. In such embodiments, each set of cutting members can be selectively extended.

In one embodiment, the cutting members 402 are disposed in a sleeve or sub 404 fixed to the drill string 204. Thus, rotation of the drill string 204 will cause the rotation of the cutting members 402. In another embodiment, the cutting members 402 are disposed in a sleeve or sub 404 that can rotate relative to the drill string 204. A downhole motor connected to the sleeve or sub 404 rotates the cutting members 402. In yet other embodiments, the cutting members 402 can be rotated by both drill string rotation and a downhole motor 208 (e.g., a dedicated motor or the drilling motor). For instance, the mill 400 can be mechanically coupled via retractable splines to a shaft (not shown) connected to the drill bit 200 so that the motor used to rotate the bit 200 can also be used to rotate the mill 400. In such an arrangement, the mill 400 can be positioned proximate the bit 200 and downhole of the motor 208.

It should be understood that the mill 400 does not necessarily have to remove all of the casing metal or all of the cement on the exterior of the casing 12. For instance, the mill 400 need only weaken the wall of the casing to a point where the drill bit 200 can cut through the casing 12. Furthermore, in some applications, the casing 12 may have been prepared in advance of the milling process. For instance, chemical, explosive or mechanical casing cutters deployed via a work string (e.g., wireline, slickline, coiled tubing, jointed tubular, etc.) may be used to weaken a region of the casing 12 that is selected as the exit point for the side track.

A stabilizer 500 can be used to center and stabilize the mill 400 in the wellbore 14 during the milling operation. An exemplary stabilizer 500 can include blades 501 that are fixed. The stabilizer 500 can also include "active" or dynamically adjustable blades that can be independently expanded and retracted. In some embodiments, the blades 501 of the stabilizer provide radial stability while allowing the mill 400 to move axially along the wellbore 14. In other embodiments, the stabilizer blades 501 are configured to lock or anchor the mill 400 against the casing 12 to counter non-radial reaction forces produced by the cutting action of the mill 400. Further, the blades 501 can have a dynamically adjustable radial length to assist in bending the BHA 100 during entry into the milled open hole 16. Stabilizers are known in the art and will not be discussed in further detail. Other stabilizers (not shown) can be provided adjacent the steering unit 300 and uphole of the mill 400 to stabilize and center the BHA 100, drill string 204 and other components discussed above. It should be understood that other devices such as inflatable bladders can also be used to stabilize and/or center the several BHA 100 components. Moreover, in certain embodiments, the steering unit (e.g., steering unit 320) may be used to stabilize and/or center the mill 400.

A flex sub 600 provided adjacent and uphole of the steering g sub 300 allows the steering unit 300 to change drill bit 200 orientation relative to the wellbore 14 by providing a controlled bend radius for the drill string 204. Flex subs are known in the art and will not be discussed in further detail. In certain arrangements, a plurality of flex subs can be used introduce sufficient articulation in the drill string to allow the steering unit 300 to deflect the drill bit. In other arrangements, the characteristics of the drill string (e.g., size, shape, material) may permit the drill string 204 to bend to accommodate the operation of the steering unit 300 without the inclusion of a separate flex sub.

The teachings of the present invention can be applied to a variety of drilling systems. For instance, for coiled tubing conveyed systems, the BHA 100 can use a local source for rotating the drill bit 200 such as mud motor or drilling motor 208 above or uphole of the drill bit 200. Suitable drilling motors 208 include positive displacement motors and turbines. Further, electrically driven motors may be used in lieu of or in addition to hydraulically driven motors. For top or rotary drive systems, a surface source (not shown) rotates a drill string 204 coupled to the BHA 100 to thereby rotate the drill bit 200. Rotation by the drill string 204 can be superimposed on rotation by the motor 208 or used as the sole rotational drive mechanism for the bit 200. Additionally, the BHA 100 can include devices such as a thruster (not shown), which may be hydraulically actuated, for providing axial thrust (or weight-on-bit) for the bit 100.

Furthermore, the teachings of the present invention and the embodiments described above can be advantageously applied in any phase of hydrocarbon recovery operations (e.g., well construction, completion, workover, etc.) and deployed from platforms/rigs situated offshore or on land.

Figure 3:
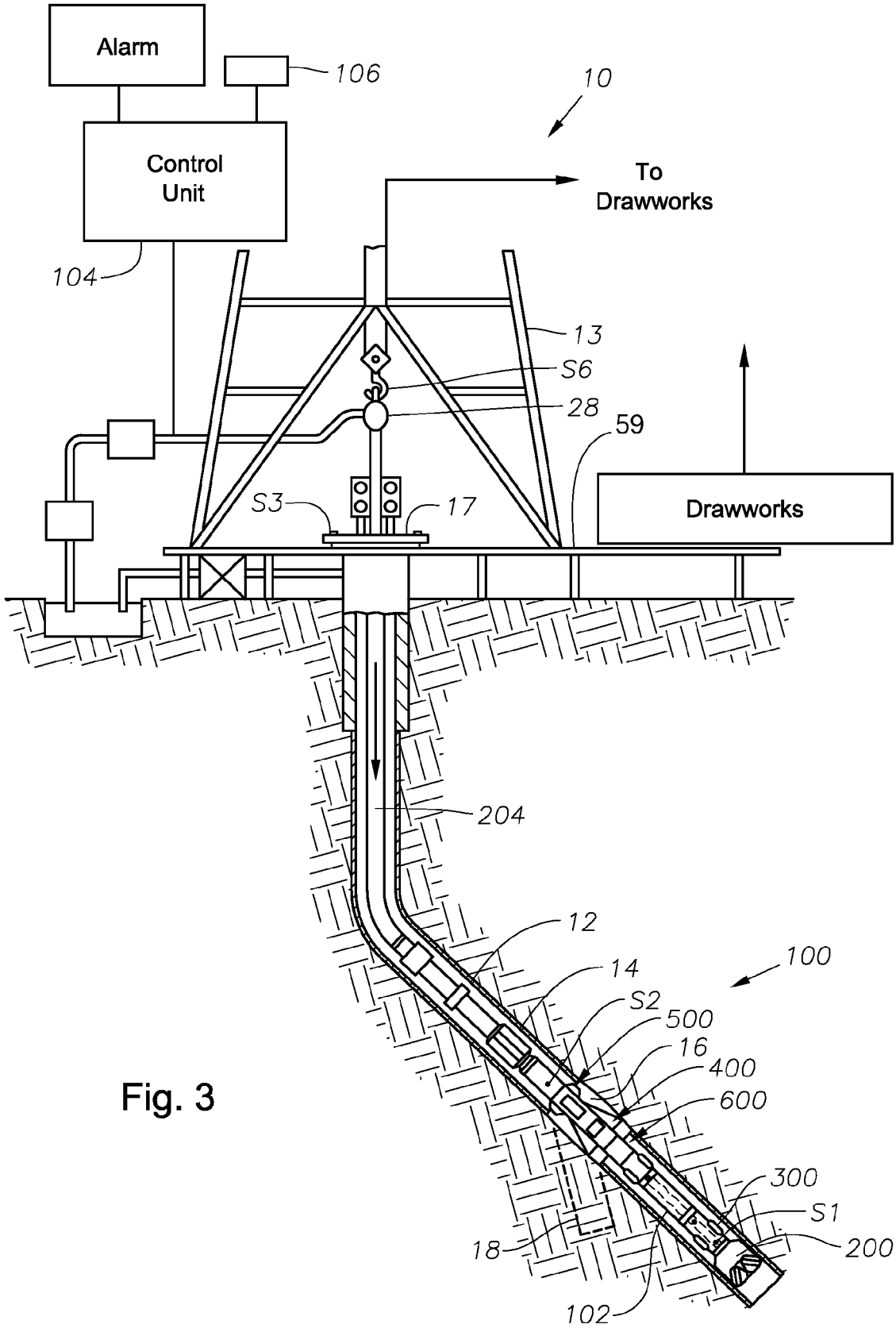
FIG. 3 is a schematic view of a drilling system utilizing the BHA of FIG. 1.

Merely for convenience, FIG. 3 illustrates a land-based drilling system 10 utilizing a BHA 100 made according to one embodiment of the present invention. The system 10 shown in FIG. 3 has a BHA 100 described above (FIG. 1) conveyed into a wellbore 12. The drilling system 10 includes a derrick 13 erected on a floor 59 that supports a rotary table 17 that is rotated by a prime mover. The drill string 204 (e.g., jointed tubulars or coiled tubing) extends downward from the rotary table 17 into the wellbore 12. Other related components and equipment of the system 10 are well known in the art and is thus not described in detail herein. The system can, of course, be also used in off-shore applications.

In the FIG. 3 embodiment, the system 10 uses on-board sensors to measure selected parameters of interest to control the BHA 100 and to characterize (e.g., map) the formation. The sensors of the BHA 100, which are collectively referred to with the numeral S1, preferably include navigation devices, such as gyro devices, magnetometer, inclinometers or either suitable combinations, to provide information about parameters that may be utilized downhole or at the surface to control the azimuthal orientation of the BHA 100 and drilling direction. A number of additional sensors (not shown), may be disposed in a motor assembly housing or at any other suitable place in the BHA 100. The sensors may include (i) borehole parameter sensors for determining temperature and pressure in the wellbore, (ii) drilling motor parameter sensors for measuring the fluid flow rate, pressure drop, torque, and the rotational speed (RPM) of the drilling motor; (iii) formation evaluation sensors such as measurement-while-drilling devices or logging-while-drilling devices for determining various formation parameters such as resistivity, porosity of the formations, density of the formation, and bed boundary information; and (iv) BHA parameter sensors for measuring BHA bit bounce, stick-slip of the BHA, backward rotation, torque, shocks, BHA whirl, BHA buckling, borehole and annulus pressure anomalies and excessive acceleration or stress.

In one embodiment, the BHA 100 includes a sensor for measuring one or more parameters of interest related to the structural integrity of the cased section 12 of the wellbore 14. For instance, a sensor S2 can be configured to determine the adequacy of the bonding of the cement to the outside of a casing (i.e., acoustic cement bond logging). Forming an opening in a section of the cased wellbore that has less than adequate cement bonding could allow wellbore fluids (e.g., production fluids) to leak out at the juncture between the sidetrack and the main wellbore. Thus, to increase the likelihood of proper hydraulic zonal isolation, the acoustic cement logging sensor S2 can be used to survey a selected kick-off or exit point to locate one or more regions best suited for milling and the subsequent side-track.

Intelligent control of the BHA 100 is provided by a controller 102 that includes one or more microprocessors or micro-controllers and memory devices. The controller 102 receives the signals from the various downhole sensors S1-2, determines the values of the desired parameters based on the algorithms and models provided to the controller 102 and in response thereto controls the various downhole devices, including the force vectors generated by the steering unit 300. The wellbore profile may be stored in the memory of the controller 102. The controller 102 may be programmed to cause the BHA 100 to adjust the steering unit 300 to direct the BHA 100 into the open hole section 16 of the cased wellbore 12 and/or drill the wellbore along the desired profile. Commands from the surface or a remote location may be provided to the controller 102 via a two-way telemetry (not shown). Data and signals from the controller 102 are transmitted to the surface via the telemetry.

In some embodiments, the BHA controller 102 cooperates with a surface controller 104 to control operation of the BHA 100. The surface controller 104 receives signals from the downhole sensors S1-2 and devices and any other sensors used in the system and processes such signals according to programmed instructions provided to the surface controller 104. These signals may have been processed by the BHA controller 102 before transmission (e.g., digitized and filtered) to reduce bandwidth. The surface controller 104 displays desired drilling parameters and other information on a display/monitor 106 and is utilized by an operator to control the drilling operations. The surface controller 104 contains a computer, memory for storing data, recorder for recording data and other peripherals. The surface controller 104 processes data according to programmed instructions and responds to user commands entered through a suitable device, such as a keyboard or a touch screen. In certain embodiments, the surface controller 104 controls drilling operations without the BHA controller 102.

Referring to FIGS. 1-3, the system 10 can be deployed to efficiently form the side-track or branch bore 18 from a main wellbore 12 at a selected kick-off point 20. In an exemplary deployment, the BHA 100 is assembled at the surface and tripped into the wellbore 12. The depth at which the side-track is to be initiated (kick-off or exit point) may have been determined using data collected from a prior survey. Likewise, the cement bonding of the selected kick-off point 20 may have been checked by a prior acoustic log. The sensors S1-2 of the drilling system 100 may be used to supplement and/or verify the previously collected information. In certain applications, the sensors S1-2 can survey the formation and wellbore and provide the measurements used to select the kick-off point. For instance, the acoustic sensors S2 can confirm that the selected kick-off point 20 has sufficient cement bonding to ensure hydraulic zonal isolation.

After the BHA 100 is run into the wellbore 14, the cutting mill 400 is positioned vertically adjacent the anticipated kick-off point 20. Surface sensors S3 and/or sensors S1-2 can be used to verify the mill 400 is at the selected depth. The stabilizer 500 can be energized (if they include active blades) to center or anchor the mill 400 in the wellbore. With the mill 400 so positioned, a surface signal is transmitted to the mill actuation device 405 to expand the cutting members 402 of the mill 400 into cutting engagement with the interior of the casing 12. The signal may be the transmission of an electrical signal to a downhole motor or the pumping of pressurized drilling fluid through the drill string 204.

In one arrangement, a surface source such as the rotary table 17 is energized to rotate the drill string 204 and mill 400. In other arrangements, a downhole motor coupled to the mill 400 is energized with electrical power and/or pressurized hydraulic fluid to rotate the mill 400. As the mill 400 rotates, the cutting members 402 remove the metal or other material making up the casing 14. During milling, drilling fluid can be circulated down the drill string 204 and up an annulus formed between the drill string 204 and wellbore 14 to lubricate and cool the cutting members 402. The drilling fluid can also be circulated down the annulus and return up through the drill string 204. However, drilling fluid circulation may not be necessary in certain applications. The drill string 204 can be manipulated such the mill 400 moves longitudinally (either uphole or downhole) to form an elongated open hole section or window 16 in the casing 14. Sensors, such as the acoustical sensors S1, can be used to re-check the open hole section and the integrity of the casing 12 and below the open hole section.

Once the open hole section 16 has been formed, the BHA 100 is moved uphole until the drill bit 200 is positioned adjacent the open hole section 16. To initiate the drilling of the sidetrack, a command signal is sent by a surface or downhole controller 102,104 to adjust the radial positioning of the force application members 304 of the steering unit 300. For instance, the actuation of a modified force application member 304*a* causes the arm 304*b* to engage the wellbore wall and displace the bit 200 in a selected or pre-determined direction (e.g., azimuth, inclination) into the open hole section 16. Upon contacting an exposed wall 19 of the open hole section 16 by the drill bit 200, continued operation of the modified force application member 304*a* produces a force F1 that causes a bit force BF at the drill bit 200. The force F1 is maintained as the drill bit 200 is rotated to cut into the exposed surface 19 of the open hole section 16. The bit 200 can also be urged into the open hole section 16 by, for example, manipulation of the drill string 204 or operation of a thruster. In one embodiment, an active blade 501 of the stabilizer 500 is actuated to engage the casing 12 and generate a side force F2 that can further bend the BHA 100. Upon confirmation that the bit 200 is oriented satisfactorily, drilling through the sidetrack bore 22 can commence. For instance, the controllers 102,104 can monitor the drilling direction from the inclination and navigation sensors in the BHA 100 and in response thereto adjust or manipulate the force application members in a manner that causes the drill bit 200 to drill along a selected direction.

It should be understood that the terms "branch" or "main" do not imply any particular dimensions, shape or orientation for a wellbore. For instance, the "branch" wellbore can extend from a vertical, deviated, and even horizontal section of a "main" wellbore. Moreover, the "main" wellbore may itself be a branch of another wellbore.

The foregoing description is directed to particular embodiments of the present invention for the purpose of illustration and explanation. It will be apparent, however, to one skilled in the art that many modifications and changes to the embodiment set forth above are possible without departing from the scope and the spirit of the invention. It is intended that the following claims be interpreted to embrace all such modifications and changes.

We claim:

1. A method of forming a branch wellbore from a main wellbore having a casing in at least a section of the well, comprising:

(a) providing a bottomhole assembly (BHA) including a drill bit, a force application member, and a mill separate from the drill bit, the mill having at least one expandable cutting element;

(b) conveying the BHA into the wellbore with a drill string;

(c) positioning the mill adjacent the cased section of the main wellbore;

(d) cutting a portion of the casing with the mill by expanding the at least one cutting element, a substantially open hole portion being formed thereby;

(e) manipulating the drill string to position the drill bit adjacent the open hole portion;

(f) operating the force application member to guide the drill bit into the open hole portion; and (g) drilling the branch wellbore with the drill bit.

2. The method according to claim 1, wherein cutting a portion of the casing includes centering the mill in the wellbore and rotating the mill by one of (i) rotating the drill string; and (ii) a downhole motor.

3. The method according to claim 1, wherein drilling the branch wellbore includes rotating the drill bit by one of (i) a motor; and (ii) combined drill string and motor rotation.

4. The method according to claim 1, further comprising providing the BHA with a steering unit adapted to steer the drill bit.

5. The method according to claim 4, wherein the steering unit is adapted to alter geometry of a BHA centerline to point the drill bit in a selected direction; and wherein the steering unit includes at least two set of axially spaced apart force application members.

6. The method according to claim 4 wherein the force application member is positioned on the steering unit; and further comprising centering the mill with a stabilizer.

7. The method according to claim 4 wherein the steering unit includes a plurality of force application members, at least one of the force application members being larger than the other force application members and being adapted to guide the drill bit into the milled open hole portion.

8. The method according to claim 1, further comprising logging the section of the casing milled to determine cement bonding.

9. The method according to claim 1, further comprising determining the orientation of the drill bit using at least one sensor provided on the BHA.

10. The method according to claim 1, further comprising controlling the steering unit using a controller.

11. A drilling apparatus for forming a branch wellbore from a cased section of a main wellbore, comprising:

(a) a drill string having a drill bit at an end thereof;

(b) a mill carried by the drill string and separate from the drill bit, the mill having at least one expandable cutting element being adapted to cut casing at the cased section of the wellbore to provide an opening for forming the branch wellbore; and a force application member positioned on the drill string, the force application member adapted to guide the drill bit into the opening formed by the mill.

12. The drilling apparatus according to claim 11, wherein the force application member includes an extensible rib that engages a wellbore wall when actuated.

13. The drilling apparatus according to claim 11, wherein the mill is rotated by one of (i) rotating the drill string; and (ii) a downhole motor; and further comprising a stabilizer substantially centering the mill in the wellbore when the mil is rotated.

14. The drilling apparatus according to claim 11 further comprising a steering unit adapted to steer the drill bit.

15. The drilling apparatus according to claim 14, wherein the steering unit include a plurality of independently operable members adapted to provide one of (i) force and (ii) lateral displacement.

16. The drilling apparatus according to claim 14, wherein the force application member is positioned on the steering unit.

17. The drilling apparatus according to claim 14, wherein the steering unit is adapted to alter geometry of a BHA centerline to point the drill bit in a selected direction.

18. The drilling apparatus according to claim 14, wherein the steering unit includes at least two sets of spaced apart force application members, the at least two sets of force application members cooperating to position the drill bit in a selected orientation.

19. The drilling apparatus according to claim 14, further comprising a controller for controlling the steering unit.

20. The drilling apparatus according to claim 14, wherein the drill bit is rotated by one of (i) a motor; and (ii) combined drill string and motor rotation.

21. The drilling apparatus according to claim 11, further comprising at least one sensor provided on the BHA, the at least one sensor being adapted to determine the orientation of the drill bit.

22. The drilling apparatus according to claim 11, further comprising at least one sensor measuring the bond between cement and the casing.

23. A system for drilling a branch wellbore from a cased section of a main wellbore, comprising:

(a) a rig positioned over the wellbore;

(b) a drill string conveyed into the wellbore from the rig;

(c) a bottomhole assembly (BHA) coupled to an end of the drill string, the BHA including:

(i) a drill bit;

(ii) a mill separate from the drill bit and adapted to cut casing at the cased section of the wellbore to provide an opening for forming the branch wellbore, the mill having at least one expandable cutting element; and (iii) a force application member adapted to guide the drill bit into the opening formed by the mill.

24. The system according to claim 23 wherein the mill is rotated by one of (i) rotating the drill string; and (ii) a downhole motor.

25. The system according to claim 23, wherein the force application member includes an extensible rib that engages a wellbore wall when actuated.

26. The system according to claim 23 further comprising a steering unit adapted to steer the drill bit.

27. The system according to claim 26 wherein the steering unit includes at least two sets of spaced apart force application members, the at least two sets of force application members cooperating to steer the drill bit.

28. The system according to claim 26, wherein the force application member is positioned on the steering unit.

29. The system according to claim 26 wherein the steering unit includes a plurality of independently operable members adapted to provide one of (i) force and (ii) lateral displacement.

30. The system according to claim 26, wherein the steering unit is adapted to alter geometry of a BHA centerline to point the drill bit in a selected direction.

31. The system according to claim 23, wherein the drill bit is rotated by one of (i) a motor; and (ii) combined drill string and motor rotation.

32. The system according to claim 17 further comprising at least one sensor for measuring the bond between cement and the casing.

33. The system according to claim 17 further comprising at least one sensor provided on the BHA for determining the orientation of the drill bit.

34. A method of forming a branch wellbore from a main wellbore having a casing in at least a portion of the well, comprising:

(a) providing a bottomhole assembly (BHA) including a drill bit, a steering unit, and a mill separate from the drill bit, the mill having at least one expandable cutting element;

(b) positioning the mill adjacent a selected location in the wellbore tubular;

(c) cutting a section of the casing with the mill to form a window using the at least one expandable cutting element;

(d) manipulating the BHA to position the drill bit adjacent the window;

(e) operating the steering unit to guide the drill bit into the window; and (f) drilling the branch well with the drill bit.

35. The method according to claim 34, wherein manipulating the BHA includes moving the drill bit in an uphole direction.

36. The method according to claim 34, further comprising positioning the steering unit between the mill and the drill bit.

37. The method according to claim 34, further comprising surveying the selected location before milling the window.

38. The drilling apparatus according to claim 11, wherein the steering unit is positioned between the mill and the drill bit.

39. The drilling apparatus according to claim 11, wherein the steering unit includes a plurality of force application members, wherein at least one force application member is longer than the other force application members.

40. The drilling apparatus according to claim 11, wherein the steering unit includes a plurality of force application members in a non-rotating sleeve.

* * * * *

UNITED STATES PATENT AND TRADEMARK OFFICE

CERTIFICATE OF CORRECTION

PATENT NO. : 7,306,056 B2
APPLICATION NO. : 10/977671
DATED : December 11, 2007
INVENTOR(S) : Ray Ballantyne and Joachim Oppelt It is certified that error appears in the above-identified patent and that said Letters Patent is hereby corrected as shown below:

Column 10, line 24 should read as follows:

--unit includes at least two sets of axially spaced apart force--

Signed and Sealed this

Eighth Day of December, 2009

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,306,056 B2
APPLICATION NO. : 10/977671
DATED : December 11, 2007
INVENTOR(S) : Ray Ballantyne and Joachim Oppelt It is certified that error appears in the above-identified patent and that said Letters Patent is hereby corrected as shown below:

Column 10, claim 11, line 48, delete "cut casing", insert --cut a portion of the casing--;

Column 10, claim 13, line 60, delete "mil", insert --mill--; and

Column 10, claim 15, line 65, delete "include", insert --includes--.

Signed and Sealed this

Second Day of February, 2010

David J. Kappos

David J. Kappos
*Director of the United States Patent and Trademark Office*